US011873061B2

(12) United States Patent
Salmela

(10) Patent No.: US 11,873,061 B2
(45) Date of Patent: Jan. 16, 2024

(54) LIFESAVING BOAT HULL HANDLE SYSTEM

(71) Applicant: James Salmela, Palm Bay, FL (US)

(72) Inventor: James Salmela, Palm Bay, FL (US)

( * ) Notice: Subject to any disclaimer, the term of this patent is extended or adjusted under 35 U.S.C. 154(b) by 0 days.

(21) Appl. No.: 18/196,987

(22) Filed: May 12, 2023

(65) Prior Publication Data

US 2023/0365231 A1 Nov. 16, 2023

Related U.S. Application Data

(60) Provisional application No. 63/341,142, filed on May 12, 2022.

(51) Int. Cl.
*B63B 17/00* (2006.01)
*B63C 9/28* (2006.01)

(52) U.S. Cl.
CPC ..... *B63B 17/00* (2013.01); *B63C 9/28* (2013.01)

(58) Field of Classification Search
CPC .. B63B 17/00; B63C 9/00; B63C 9/02; B63C 9/28
See application file for complete search history.

(56) References Cited

U.S. PATENT DOCUMENTS 980,790 A 1/1911 Johnson
1,050,045 A * 1/1913 Sivard ..... B63B 2043/126 251/98
1,168,982 A * 1/1916 Walker ..... B63C 7/00 114/343
1,383,551 A 7/1921 Lowndes
1,402,496 A * 1/1922 Hoffman ..... B63G 8/04 114/218
1,746,769 A 2/1930 Ghiradri
2,510,843 A 6/1950 Townshend
3,216,030 A 11/1965 Garfield
(Continued)

FOREIGN PATENT DOCUMENTS

GB 460259 A * 1/1937
GB 2354739 A 4/2001

OTHER PUBLICATIONS

Anthony Steward, Around Alone in an Open Boat (Internet Publication); Jan. 2002; Retrieved from https://www.dixdesign.com/steward.htm.

(Continued)

*Primary Examiner* — Ajay Vasudeva
(74) *Attorney, Agent, or Firm* — Lowndes; Robert R. Fredeking; Robert F. Fredeking

(57) ABSTRACT

A lifesaving handle system for a watercraft surface such as, but not limited to, a boat hull. The handle system remains inside a cavity in an exterior surface of a watercraft hull when the watercraft is upright (i.e., when it is not capsized) such as when it is flowing on a body of water in normal operation. The handle may be rotatably attached to an interior surface of the cavity such that when the boat is upright, as in non-capsized operation, the handle hangs vertically in the closed cavity and is not within the flow of water passing along and around the watercraft hull when the boat is motivated on a body of water; and when the boat is overturned or capsized, the handle rotates out from the closed cavity under the force of gravity such that the grip handle is presented to a person in the water.

21 Claims, 11 Drawing Sheets

Fig. 4

(56) References Cited

U.S. PATENT DOCUMENTS

| | | | | | |
|---|---|---|---|---|---|
| 3,417,725 | A | | 12/1968 | Fisher | |
| 3,952,350 | A | | 4/1976 | Moucka | |
| 4,003,099 | A | | 1/1977 | Hivko | |
| 4,328,761 | A | | 5/1982 | Dwyer | |
| 4,589,163 | A | | 5/1986 | Weatherby et al. | |
| 4,788,927 | A | * | 12/1988 | Casey | B63B 21/56 114/218 |
| 4,964,355 | A | * | 10/1990 | Milewski | B63B 21/045 114/218 |
| 4,986,785 | A | | 1/1991 | Flowers | |
| 5,102,360 | A | | 4/1992 | Eycleshimer | |
| 5,598,803 | A | * | 2/1997 | Czipri | B63B 21/04 114/218 |
| 6,154,929 | A | | 12/2000 | Dwyer | |
| 8,777,683 | B2 | | 7/2014 | Friedman | |
| 10,538,289 | B1 | * | 1/2020 | Cifers | B63B 17/00 |
| 2006/0096518 | A1 | | 5/2006 | Hulbert | |

OTHER PUBLICATIONS

Amazon, Mxeol Boat Recessed Hatch Pull Ring Flush Lifting Handle Marine Stainless Steel 3" Pair ; Feb. 11, 2022 Retrieved from https://www.amazon.com/MxEol-Recessed-Handle-Marine-Stainless/dp/B07B6426J2.

NPL-3 Low Profile Square Lift Handle; 2022 Retrieved from https://www.boatoutfitters.com/low-profile-square-lift-handle?gclid=EA1a1QobChM1qoHSg8b79QIViP_jBx3vAAMNEAQYAiABEgIKOPD_BWE.

NPL-1 SEA & SEA Buoyancy Arm Handle; 2022 Retrieved from http://www.diversion.com/seaandsea-buoyancy-arm-handle-46124.html.

* cited by examiner

LIFESAVING BOAT HULL HANDLE SYSTEM

CROSS REFERENCE TO RELATED APPLICATIONS AND INCORPORATION BY REFERENCE

This patent application is a non-provisional of, and claims benefit of priority to, United States Provisional Patent Application No. 63/341,142, filed in the United States Patent and Trademark Office (USPTO) on May 12, 2022, entitled LIFESAVING BOAT HULL HANDLE SYSTEM, the entire disclosure of which is incorporated herein by reference.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to apparatuses, systems and methods for providing handles, grips and other features enabling a person to grasp the handle, grip or other feature of a capsized watercraft hull. The field of the invention may further be described as lifesaving features forming a part of, or attached to, the hull of a capsized watercraft (which may be any floating structure, for example vehicle, boat, floating dock, or the like, powered or unpowered, including but not limited to a boat) that allows a person in the water to grasp the feature so as to remain with the capsized watercraft while awaiting rescue.

2. Background Art

It is often the case that watercraft, such as but not limited to boats, watercraft, jet-skis, canoes, kayaks, docks, floating docs, paddleboards, or other vessels or structures that float on the water (collectively herein referred for convenience as a "watercraft") in which, or on which, a person may be transported on a body of water, may capsize, leaving the occupants in the body of water awaiting rescue. There are any number of reasons a watercraft may capsize: for example, a watercraft may capsize due to the handling or maneuvering of the watercraft by the pilot causing the watercraft to be disposed in an unstable condition (for example, due to excessive speed, high speed maneuvering, overloading of the watercraft, etc.); the watercraft may suffer a structural failure such as holing of the hull or failure of a structure forming the watercraft; the boat may capsize due to impact with another watercraft or structure (such as, for example, a dock, buoy or other structure); the watercraft may encounter waves, wakes or other disturbances in a body of water of sufficient size and configuration to cause the watercraft to capsize; the watercraft may encounter inclement weather conditions such as high winds; or any number of other environmental conditions, boat operation, or other conditions that may affect the stability of a watercraft, causing it to capsize. When a watercraft capsizes and becomes disposed in an upside-down state in the water, it is often the case that the occupants of the watercraft are displaced from the watercraft into the body of water, where they must await rescue.

In such cases it is generally thought to be advisable that the former occupants of the watercraft remain with the watercraft while awaiting rescue. This, however, may be difficult, as most watercraft, especially boats, do not contain features on the watercraft that assist or enable a former occupant of the watercraft to attach themselves, or grasp, the hull of the overturned watercraft. In the case of boats, for example, most boat hulls are smooth, continuous surfaces that enable the boat to move through the water with a minimum of friction and turbulence. However, this motivation to produce boat hulls that are smooth and continuous operates against any motivation to provide grasping or attaching features in the boat hull, as such features may be seen as increasing undesired turbulence of the water flow around the boat hull as the boat hull is motivated through the body of water.

Remaining with an overturned watercraft may be a very important method for facilitating eventual rescue. Generally, an overturned watercraft is much more visible from both water level and the air than is a person floating in the water. One reason for this is that people tend to float low in the water due to their specific gravity being close to that of water. Thus, it is highly likely that a rescue observer will observe an overturned watercraft much more quickly than they will observe an individual floating by themselves in the water. In inclement weather conditions, in which include poor visibility due to wind, rain, and waves is often present, a person who has been separated from the overturned watercraft may not be visually or otherwise observable, hindering or even preventing rescue.

Unfortunately, there have been occurrences in which lives have been lost due to the inability of former occupants of a capsized watercraft to remain with the overturned watercraft while awaiting help, especially in rough seas and inclement weather. In many cases, had the former occupants of the watercraft been able grasp a feature of the hull of the overturned watercraft, or releasably attach themselves to the overturned watercraft, they would likely have survived until help arrived. The further the overturned watercraft is from shore, the more important it may be to remain with the overturned watercraft, as searches at sea may necessitate days of searching by watercraft and aircraft, covering, in some instances, hundreds of square miles of a body of water.

The simple addition of external grips to a boat hull, for example, grips in the form of handles that protrude from the hull, are not desirable because they may introduce significant drag on the boat while the boat is underway due the handle presenting a high-drag feature protruding into the flow of water moving past the hull, resulting in unwanted turbulence and drag on the boat. Ideally, any feature intended to be used as a grip would produce little or no drag while the boat is upright, i.e. is not capsized, in the water and underway, but would be automatically deployed and would be usable by a person in the water when the boat has capsized and is essentially floating upside-down in the water.

What is needed in the art, therefore, is a device, system, apparatus and/or method adapted to enable a former watercraft occupant, or any other person who has need, to grasp or releasably attach themselves to a capsized watercraft so that they are able to safely remain with the overturned watercraft awaiting rescue, that deploys automatically (without human intervention) when the boat is in a capsized position i.e. is upside down in the water, and presents little or no extra drag on the boat hull when the boat is underway.

BRIEF SUMMARY OF THE INVENTION

The present invention comprises an apparatus and method that have one or more of the following features and/or steps, which alone or in any combination may comprise patentable subject matter. The elements and features of the invention overcome the aforementioned shortcomings in the art.

In an embodiment, the invention is a gripping device, or feature, for a watercraft surface such as, but not limited to, a boat hull. The gripping device remains inside a cavity in an exterior surface of a watercraft when the watercraft is upright, or right-side-up (i.e., when it is not capsized) such as when the boat is disposed on a body of water in normal operation. The gripping device features, which may comprise, for example, a handle, may be rotatably attached to a post or other structure that is a part of, or is attached to, an interior surface of the cavity such that 1) when the boat is upright, as in normal, non-capsized operation, the grip hangs substantially vertically in the closed cavity and is not disposed within the flow of water passing along and around the watercraft hull when the boat is motivated on and through a body of water; and 2) when the boat is overturned or capsized, the grip handle automatically rotates out from the cavity under the force of gravity such that the grip handle is presented to a person in the water, who may be a former occupant of the watercraft awaiting rescue, or may, for example be a scuba diver or any other person in the body of water who has a need or desire to be supported by, or stay co-located with, the boat. In embodiments, the hull grip device of the invention may be grasped by a person in the water both when the boat is upright, and when it has been capsized.

In embodiments, the gripping device of the invention may be located in the watercraft hull so as to be above the waterline during normal, non-capsized operation of the boat. This placement of the hull grip device above the waterline prevents any drag or turbulence that may be created by water flowing along the hull of the watercraft interacting with the hull grip device of the invention. However, in embodiments, the hull grip device may also be placed below the waterline of the boat.

In embodiments, the cavity may be formed as a part of the watercraft hull (i.e., molded into the hull, as would be the case for new, or Original Equipment Manufacturer (OEM), construction) or it may be formed by cutting an opening in the watercraft hull and bonding a shell into place in the opening, sealing around the hole with a sealing or bonding agent wherein a flange of the shell contacts the exterior surface of the watercraft, such that water does not intrude into the boat hull from around or through the cavity formed by the invention. The shell, which may comprise the cavity, may be installed on a boat as an aftermarket add-on feature. The shell flange may be attached to the watercraft exterior surface, such that the shell extends into a watercraft interior volume through an opening in the watercraft exterior surface.

In embodiments, the invention may comprise a lifesaving handle system for a watercraft, comprising: a shell forming a cavity in a surface of the watercraft; a handle rotatably attached to an interior surface of the shell; wherein the handle hangs substantially in the shell cavity in a downward position while the watercraft is in normal, un-capsized state, or condition; and wherein the handle rotates away and outward from the shell cavity when the watercraft is in a capsized state or condition such that a person in a body of water in which the capsized watercraft is disposed is able to grasp the handle so as to prevent separation from the watercraft.

In embodiments, the lifesaving handle system may be molded into the watercraft surface at the time of manufacture of the watercraft. The lifesaving handle system may be attached to the watercraft surface after the time of manufacture of the watercraft. The lifesaving handle system may be, but is not necessarily, disposed in the watercraft surface at a location that is above the waterline of the watercraft when the watercraft is in normal operation. The lifesaving handle system may be, but is not necessarily, disposed in the watercraft surface at a location that is above the waterline of the watercraft when the watercraft is in a capsized state. In embodiments, the handle system may be disposed in the watercraft surface at a location that is above the waterline of the watercraft when the watercraft is in an non-capsized state, and also when it is in a capsized state.

Further, in embodiments, the shell may be molded from an organic polymer, any plastic material, or may comprise a reinforced plastic material composed of glass fibers embedded in a resin matrix, comprising, for example, fiberglass, carbon fiber, or other materials as are known in the art of boat and watercraft manufacture. The shell may be fabricated from any material other than plastics or composite structures as well. Metal and even wood may be used to form the shell.

In embodiments, the invention may comprise a boat having a lifesaving handle system, comprising: a boat comprising a lifesaving handle system, the handle system comprising: a shell forming a cavity in a surface of the watercraft; a handle rotatably attached to an interior surface of the shell; wherein the handle hangs substantially in the shell (or cavity) in a downward position while the watercraft is in normal operation; and wherein the handle rotates away and outward from the shell (or cavity) when the watercraft is in a capsized state such that a person in a body of water in which the capsized watercraft is disposed is able to grasp the handle so as to prevent separation of the person from the watercraft.

A boat or other watercraft may comprise one or more of the inventive lifesaving handle devices, or may comprise a plurality of lifesaving handle devices.

The present method and device of the invention overcome the shortcomings of the prior art by providing a device, system, apparatus and/or method adapted to enable a former watercraft occupant, or any other person who has need, to grasp or releasably attach themselves to a capsized watercraft so that they are able to safely remain with the overturned watercraft awaiting rescue. The inventive handle of the invention may be disposed in the watercraft hull so as to not interfere with water passing along and around the watercraft hull when the watercraft is motivated on and through a body of water, but when the watercraft is capsized, the grip handle rotates outward and away from the cavity and the watercraft exterior surface under the force of gravity such that the grip handle is presented to a person in the water, who may be a former occupant of the watercraft awaiting rescue. Any particular watercraft (e.g., a boat) may have any number of the inventive lifesaving hull handles of the invention installed in a hull or other surface of the watercraft, at any desired location desired. While "boat" and "hull" may be used herein as the watercraft and watercraft surface, respectively, upon which the invention is installed or disposed, it is to be understood that the inventive lifesaving handle system may be installed on any structure, including any watercraft, that may be floating or used near or on a body of water, and the inventive lifesaving handle system may be installed on any surface of such structure. I.e., the use and application of the invention is not to be construed as being limited to only boats, or boat hulls.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating exemplary embodiments of the invention and are not to be construed as limiting the invention. In the drawings.

In the embodiment shown, a counterweight gravity-assist feature in the form of protrusion 1502 assists in the automatic deployment, or outward rotation of the handle, when the watercraft is capsized (i.e. is upside down in the water).

Figure 15:
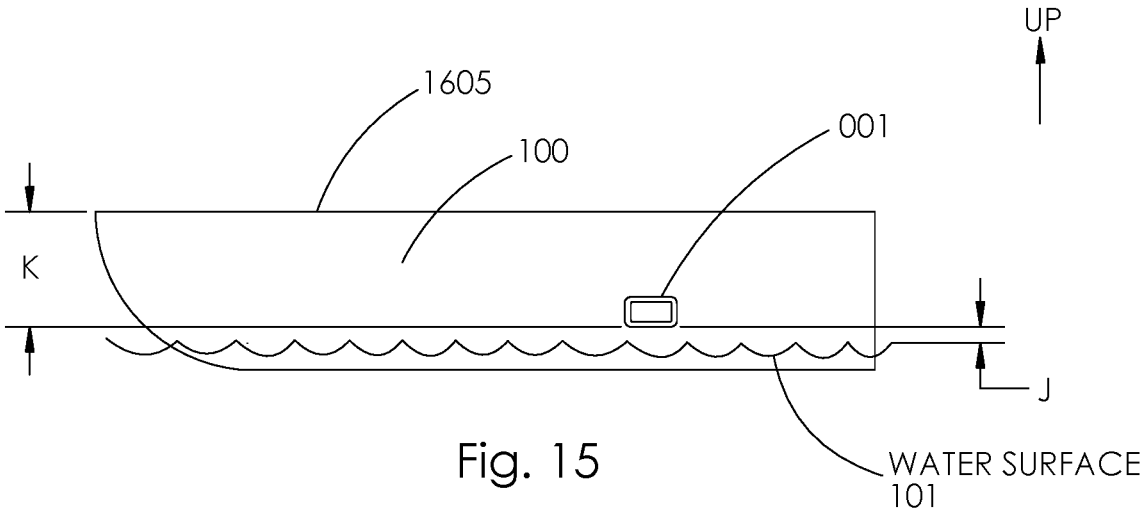
Figure 16:
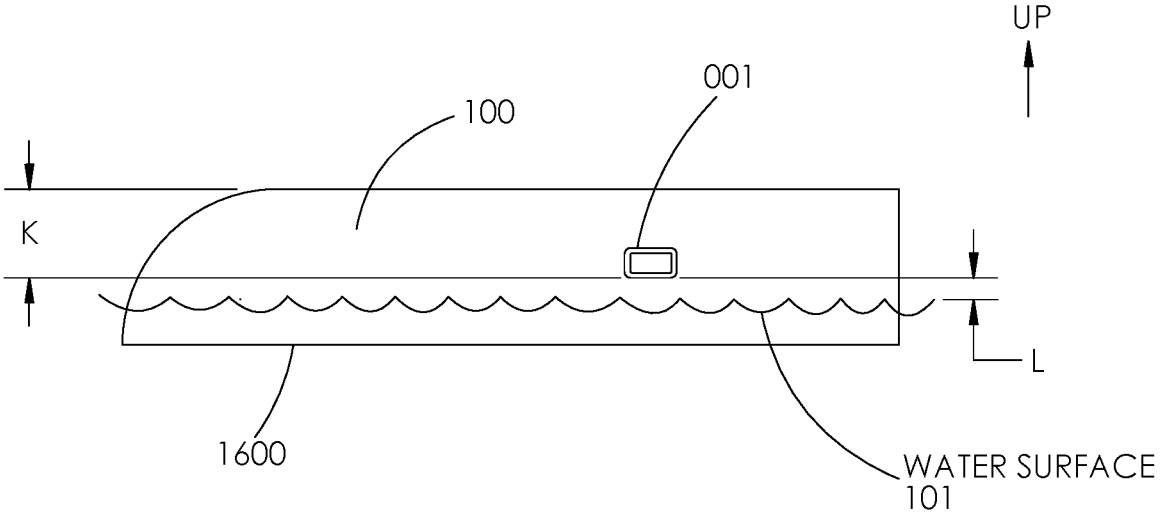

FIGS. 15 and 16 depict side views of a watercraft, in the case depicted, a boat, in normal operation, floating upright (non-capsized) on a body of water (FIG. 15) and floating in an upside-down, or capsized, state on a body of water (FIG. 16). In the example shown in the figures, the inventive lifesaving handles are located on the watercraft exterior surface 102 so as to be above the waterline of the watercraft when the watercraft is both in a capsized state and a non-capsized state.

In the figures, like callouts refer to like features. Features in the figures are not necessarily shown to scale.

DETAILED DESCRIPTION OF THE INVENTION

The following documentation provides a detailed description of the invention.

Although a detailed description as provided in this application contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus, the scope of the invention should be determined by the appended claims and their legal equivalents, and not merely by the preferred examples or embodiments given.

Figure 1:
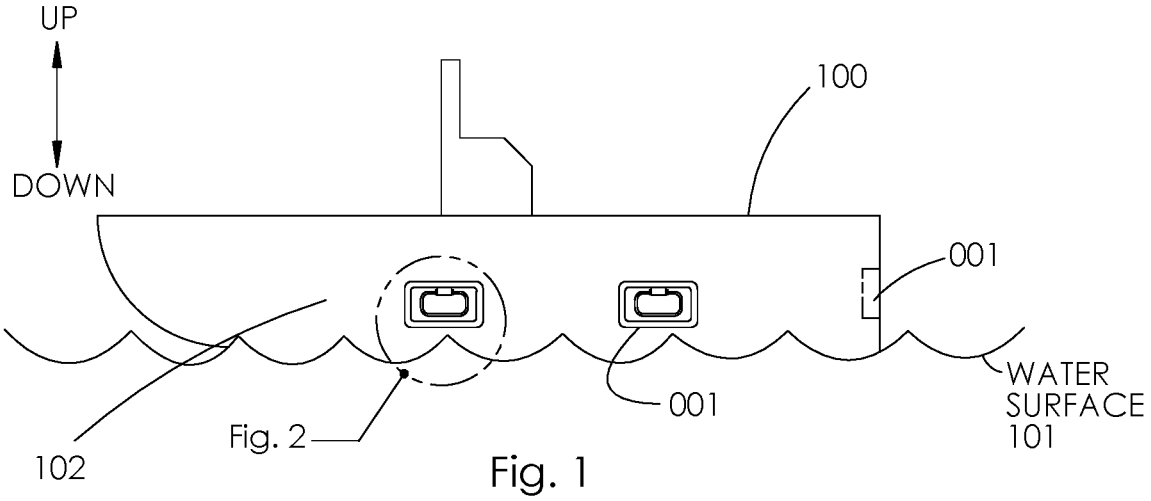
FIG. 1 depicts a side view of a watercraft, in the case depicted, a boat, in normal operation, floating upright (non-capsized) on a body of water. In the example shown in the figure, the inventive lifesaving handles are located above the normal waterline of the watercraft.

Referring now to FIG. 1, a side view of a watercraft 100, shown in the figure in exemplary fashion as a boat, in normal operation, floating upright on a body of water having a water surface 101, is depicted. The water surface 101 forms a waterline of watercraft 100 where it comes into contact with exterior surfaces 102 of watercraft 100. The watercraft 100 may have one or more exterior surfaces 102, which may be, for example, the hull of a boat, in which one or more inventive lifesaving handles 001 are installed, or disposed. In embodiments, the one or more inventive lifesaving handles 001 may be, but are not necessarily, located above the normal, un-capsized waterline of the watercraft. "UP" and "DOWN" are indicated for reference. In FIG. 1, the watercraft 100 is right side up, as it would be in normal operation, i.e. it is in a non-capsized position.

Figure 2:
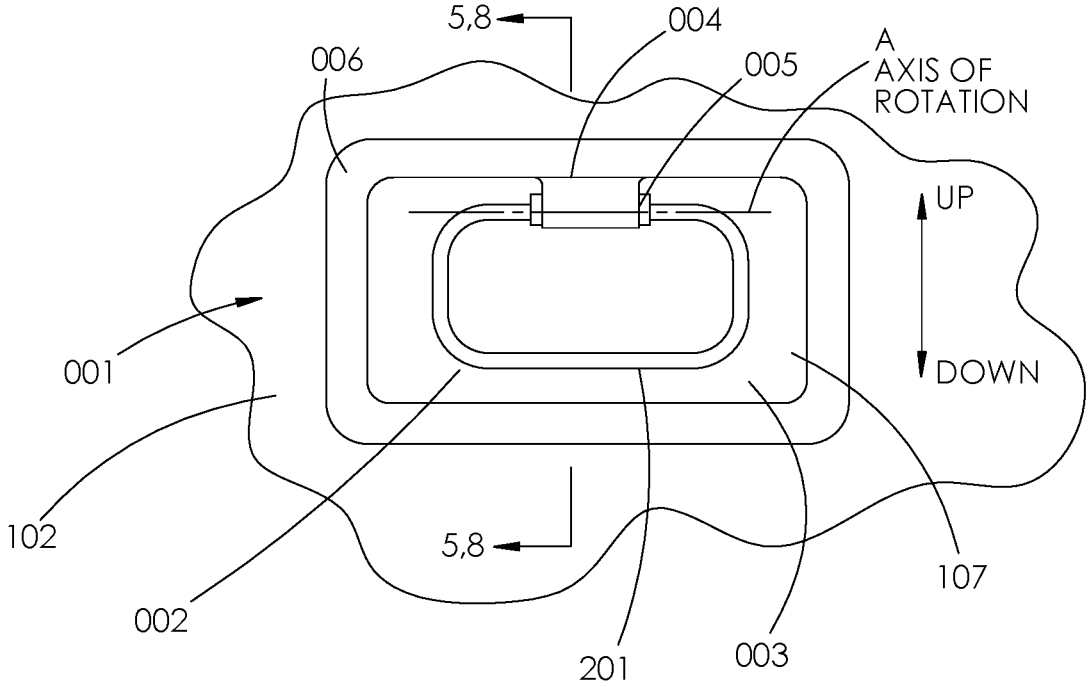
FIG. 2 depicts a front view of an embodiment of the inventive lifesaving handle system, as it would appear in use on a watercraft in normal operation (i.e., upright, or non-capsized), with the handle rotatably attached to the shell, hanging in a downward position under the force of gravity.

Referring now to FIG. 2, a front view of an embodiment of the inventive lifesaving handle system 001, as it would appear in use on a watercraft in a normal, un-capsized state, with the handle 002 rotatably attached to a hinged attachment 004 which may comprise, for example, a gudgeon having one or more openings 010 (see FIG. 5) for receiving one or more posts, or axles, comprising handle 002 at location 005 in a rotatable attachment, the rotatable attachment having an axis of rotation A. With the boat 100 (see FIG. 1) in a normal, un-capsized state, i.e., in an upright position as depicted in FIG. 1, the handle 002 may hang on its rotatable attachment to hinged attachment 004 in a downward position under the force of gravity. As is further depicted in the cross section view of FIG. 5, the handle system of the invention 001 may comprise a shell 003 having a flange 006 for attaching to surface 102 of watercraft 101 by, for example, chemical bonding means, forming a watertight seal around opening 007 in watercraft surface 102 where the flange 006 contacts the watercraft exterior surface 102 around the periphery of opening 007. In other embodiments, shell 003 and its cavity may be formed into, for example molded into, watercraft surface 102 at the time of boat manufacture at the OEM. In embodiments, handle 002 grasping portion 201 may comprise a finger grip contoured surface for at least partially receiving one more fingers, to facilitate grasping by a person in the water. The shell 003 may have an interior volume 107 for housing handle 002.

Figure 3:
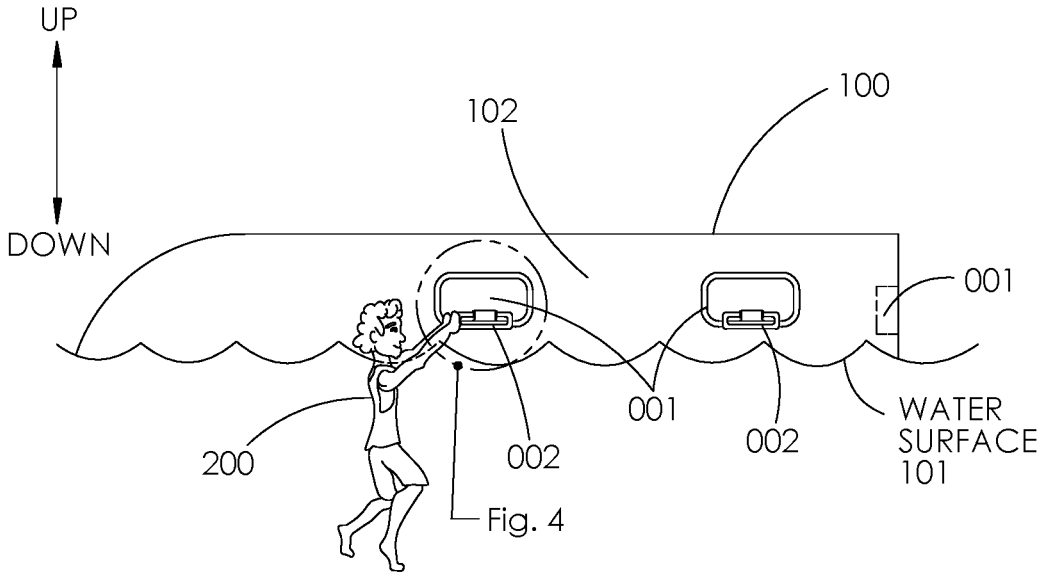
FIG. 3 depicts a side view of a watercraft, in the case depicted, a boat, in a capsized, or overturned (i.e., non-upright), state, floating upside down on a body of water. In the example shown in the figure, the inventive lifesaving handles are located above the capsized waterline of the watercraft.

Referring now to FIG. 3, a side view of a watercraft 100, in the figure, a boat in a capsized or overturned state, floating upright on a body of water having a water surface 101, is depicted. In FIG. 3, the watercraft 100 is in a capsized or overturned state, opposite to the state of normal operation as depicted in FIG. 1. The water surface 101 forms a capsized waterline of watercraft 100 where it comes into contact with surfaces 102 of watercraft 100. As depicted in FIG. 1, the watercraft 100 may have one or more surfaces 102, which may be, for example, the hull of a boat, in which one or more inventive lifesaving handles 001 are installed, or disposed. In embodiments, the one or more inventive lifesaving handles 001 disposed in watercraft surface 102 may be located above the capsized waterline of the watercraft. "UP" and "DOWN" are indicated for reference. In FIG. 3, the watercraft 100 is in a capsized or overturned state, opposite to the state of normal operation as depicted in FIG. 1. In the capsized or overturned state as depicted in FIG. 3, handle 002 has been motivated by the force of gravity G (see FIG. 6) to rotate out and away from cavity 102*a* such that a person 200 disposed in the water may grasp, or releasably attach themselves, handle 002 grasping portion 200 while they await rescue.

Figure 4:
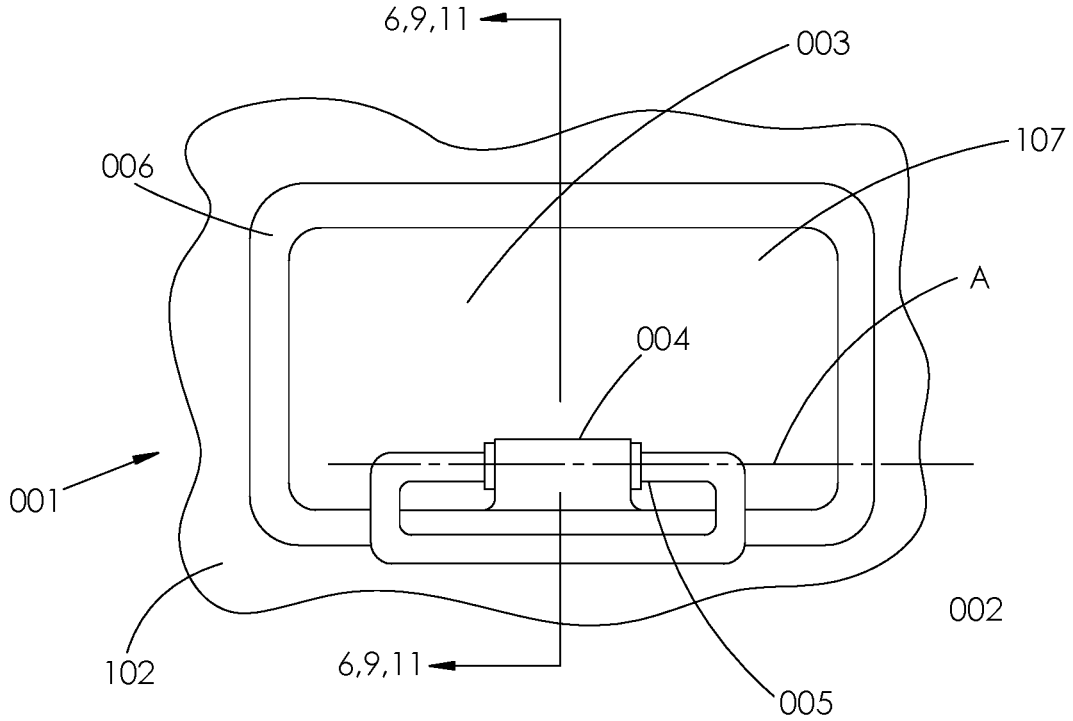
FIG. 4 depicts a front view of an embodiment of the inventive lifesaving handle system, as it would appear in use on a watercraft in a capsized, or overturned (i.e. non-upright, or upside down), state, with the handle rotatably attached to the shell. The handle of the invention has been rotated outward from the cavity under the force of gravity after the boat capsizing, such that a person in the body of water would be able to grasp the handle, or releasably attach themselves to the handle, for example while awaiting rescue.

Referring now to FIG. 4, a front view of an embodiment of the inventive lifesaving handle system 001, as it would appear in use on a watercraft 100 in a capsized, or overturned, state (see FIG. 3), with the handle 002 rotatably attached to the housing, rotated outward from the cavity 102*a* under the force of gravity G (see FIG. 6) such that a person 200 (see FIG. 3) in the body of water would be able to grasp the grasping portion 201 (see FIG. 2) of handle 002, or releasably attach themselves to the handle, for example while awaiting rescue, is depicted. In the capsized or overturned state as depicted in FIG. 3, handle 002 has been motivated by the force of gravity G to rotate outward and away from shell 003 and cavity 102*a* such that a person 200 disposed in the water may grasp, or releasably attach themselves, to handle 002 grasping portion 200 while they await rescue. As is further depicted in the cross section view of FIG. 6, the handle system of the invention 001 may comprise a shell 003 having a flange 006 for attaching to surface 102 of watercraft 101 by, for example, chemical bonding means, forming a watertight seal around opening 120 in watercraft surface 102 (see FIG. 7). In other embodiments, shell 003 may be formed into, for example molded into, watercraft surface 102 at the time of boat manufacture at the OEM. The post or other structure 004 that houses the handle 002 rotatable attachment to the shell 003 is depicted for reference. Posts or axles portions 005 of handle 002 may form rotatable attachment 010 of handle 002 with openings in post 004, said handle rotation having an axis of rotation A. The shell 003 may have an interior volume 107 for housing handle 002.

Figure 5:
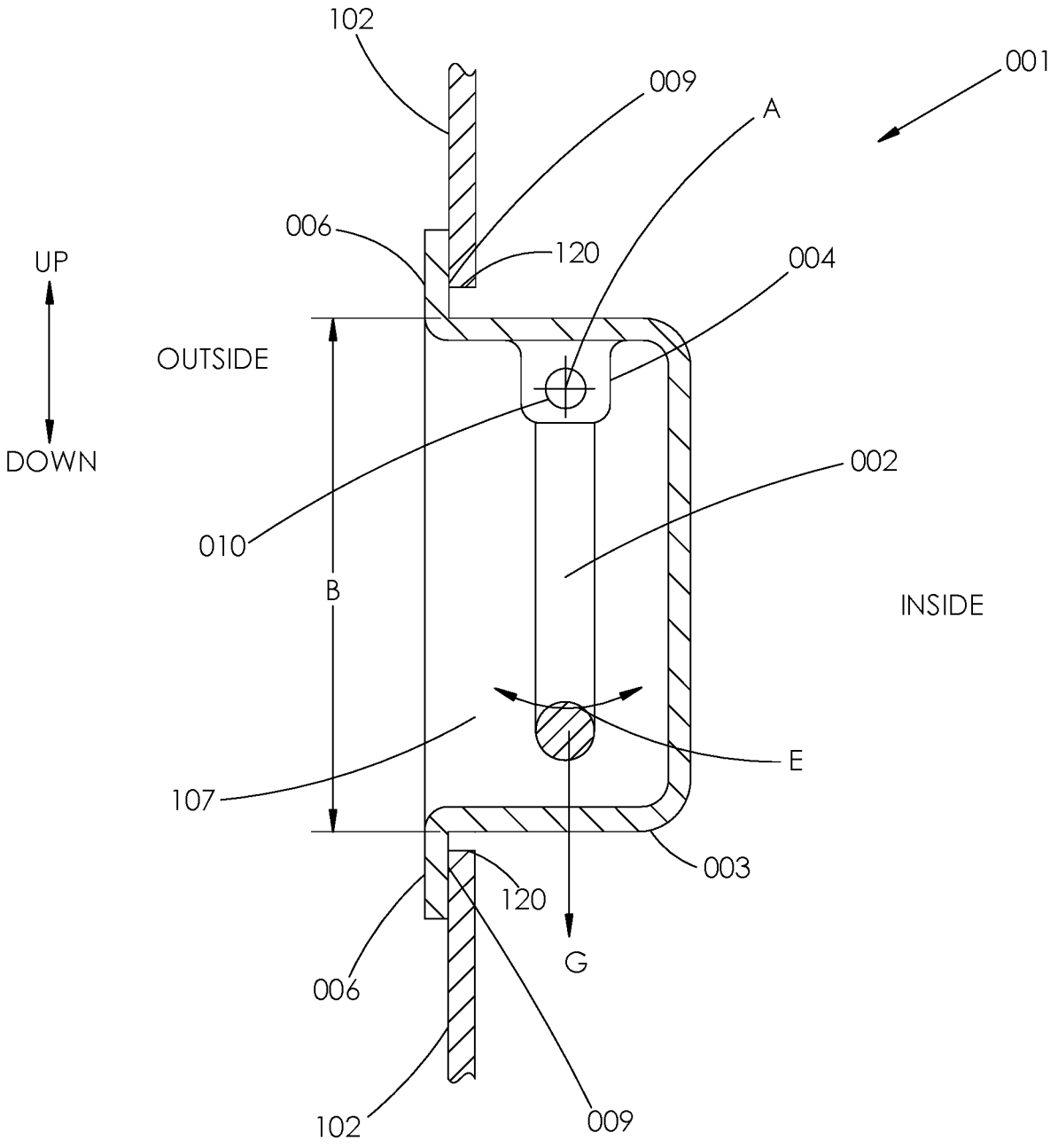
FIG. 5 depicts a cross section side view of an embodiment of the inventive lifesaving handle system, as it would appear in use on a watercraft in normal (upright, or non-capsized) operation, with the handle rotatably attached to the shell, hanging in a downward position under the force of gravity. In the embodiment depicted, the handle does not protrude beyond the boat hull exterior surface.

Referring now to FIG. 5, a cross section view of an embodiment of the inventive lifesaving handle system 001, as it would appear in .use on a watercraft 100 in normal operation (see FIG. 1), with handle 002 rotatably attached to the housing via rotatable attachment 004 having an axis of rotation A, hanging in a downward position under the force of gravity G, is depicted. Handle 002 may be rotatably attached to a hinged attachment 004 which may comprise, for example, a post or gudgeon 004 having one or more openings 010 for receiving one or more posts, or axles, 005 (see FIG. 4) comprising handle 002 in a rotatable attachment. The rotatable attachment of handle 002 to post 004, which is attached to or is a part of shell 003, allows handle 002 to swing, or rotate, around an axis of rotation A, in the direction indicated by arrow E. Shell 003 may be molded into watercraft surface 102, or it may be installed in watercraft surface 102 at, for example, the time of watercraft manufacture at the OEM, or it may be installed later as an aftermarket device. In such cases shell 003 may comprise a flange 006 for attaching to watercraft surface 102 by any known means such as, for example, chemical bonding. In embodiments, once bonded into watercraft exterior surface 102, or formed into watercraft exterior surface 102, shell 003 has no openings allowing water to pass through shell 003 from outside watercraft exterior surface 102 to an inside volume of the watercraft; and, further, the attachment of flange 006 to watercraft surface 102 at attachment surface 009 may fully surround shell 003, and may be continuously bonded or sealed to watercraft surface 102, such that no water may intrude through the attachment of flange 006 to watercraft surface 102. Thus, the installation of the lifesaving handle system of the invention onto, or into, watercraft surface 102 does not allow water to intrude into the interior of the watercraft (such as for example, into a boat hull interior space such as a bilge). Watercraft surface 102, which may be a boat hull in some cases, may comprise an opening 120 of dimension B for receiving shell 003. The shell 003 may have an interior volume 107 for housing handle 002.

Figure 6:
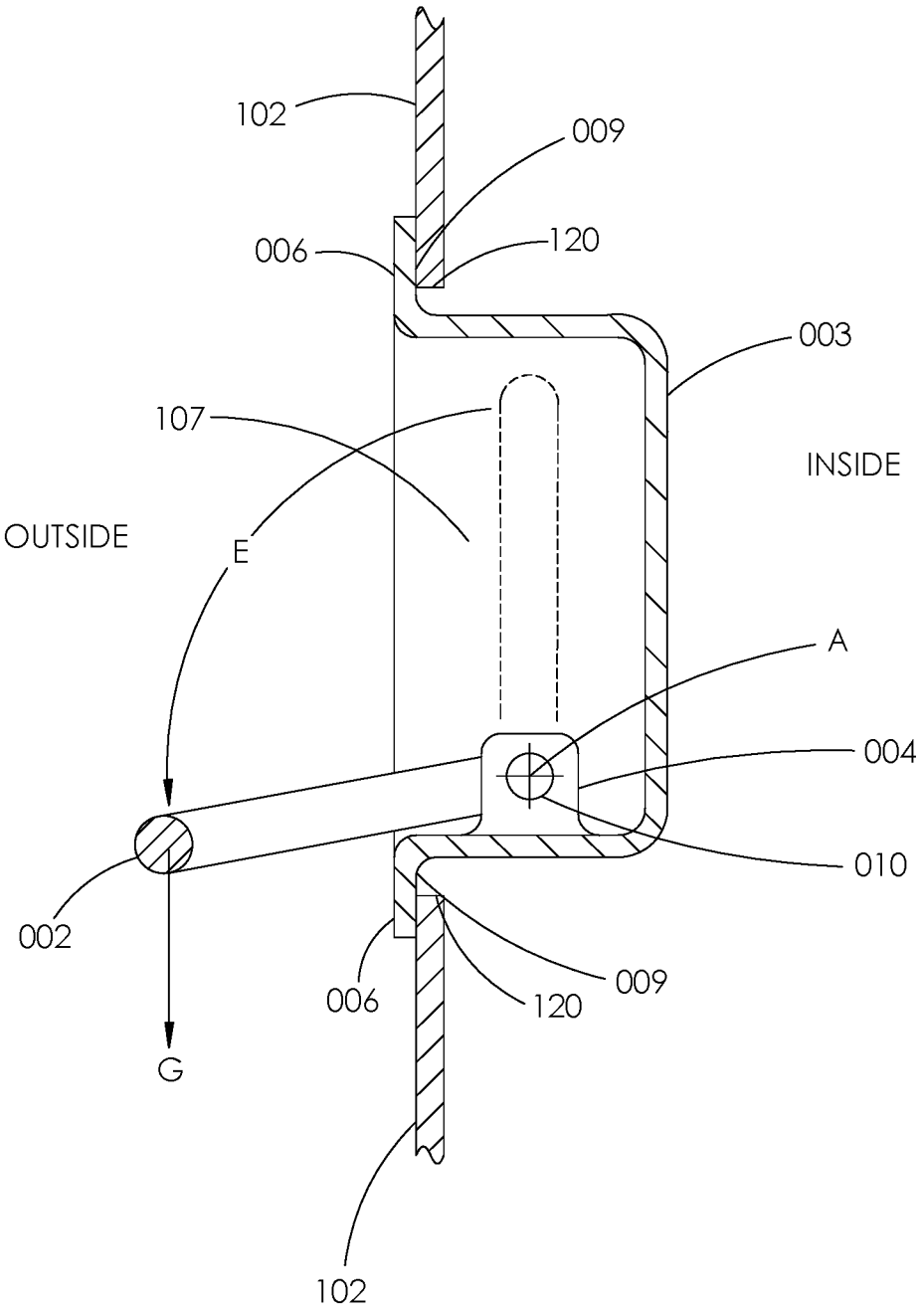
FIG. 6 depicts a cross section side view of an embodiment of the inventive lifesaving handle system, as it would appear in use on a watercraft in a capsized, or overturned (upside down), state, with the handle rotatably attached to the shell, the handle being automatically rotated outward from the cavity, in a direction away from the shell, under the force of gravity such that a person in the body of water would be able to grasp the handle, or releasably attach themselves to the handle, for example while awaiting rescue.

Referring now to FIG. 6, a cross section view of an embodiment of the inventive lifesaving handle system 001, as it would appear in use on a watercraft 100 in a capsized or overturned state (see FIG. 3), with the handle 002 rotatably attached to the housing or shell 003 via rotatable attachment with post 004, is depicted. Handle 002 has been motivated by the force of gravity G along the direction of arrow E to rotate outward from the shell 003 or cavity 102*a* under the force of gravity G such that a person 200 in the body of water would be able to grasp handle 002, or releasably attach themselves to the handle, for example while awaiting rescue. In FIG. 6, the watercraft 100 is in a capsized or overturned state, opposite to the state of normal operation as depicted in FIG. 1. In the capsized or overturned state as depicted in FIG. 6, handle 002 has been motivated by the force of gravity G to rotate outward and away from cavity 102*a* on its rotatable attachment 004 such that a person 200 disposed in the water may grasp, or releasably attach themselves, to handle 002 while they await rescue. Watercraft surface 102, which may be a boat hull in some cases, may comprise an opening 120 of dimension B for receiving shell 003. Flange 006 and flange-to-watercraft surface joint 009 are depicted for reference. The shell 003 may have an interior volume 107 for housing handle 002.

Figure 7:
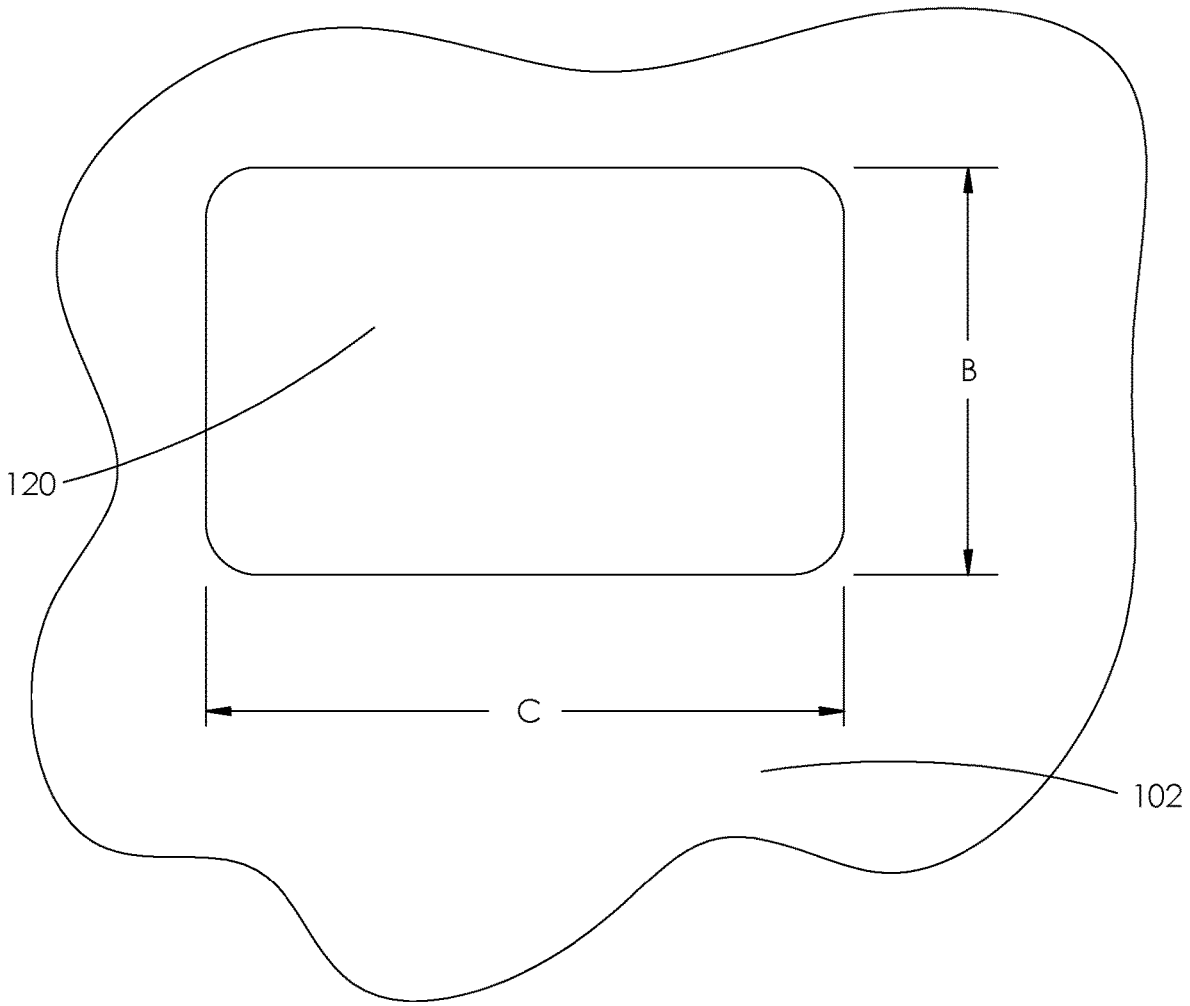
FIG. 7 depicts a view of an embodiment of a boat hull cutout for receiving the cavity of the inventive lifesaving handle system as may be used for aftermarket applications or some OEM use cases.

Referring now to FIG. 7, an exemplary, non-limiting shape of an embodiment of a cutout, or opening, 120 in watercraft surface 102 for receiving shell 003 is depicted. The cutout shape, and the shape of the shell 003, may be oval, rectangular, square, freeform, or any other desired shape as desired. In either OEM or aftermarket use cases, opening 120 may be made in watercraft surface 102 for accepting shell 003, and for attachment of flange 006 to watercraft surface 102 via chemical bonding or other attachment and/or sealing techniques as are known in the art. The cutout may take any shape to match the shell—the shape depicted in FIG. 7 is merely one exemplary shape of many shapes. In the example of FIG. 7, the shape is rectangular with a height B and a length C for accepting shell 003.

Figure 8:
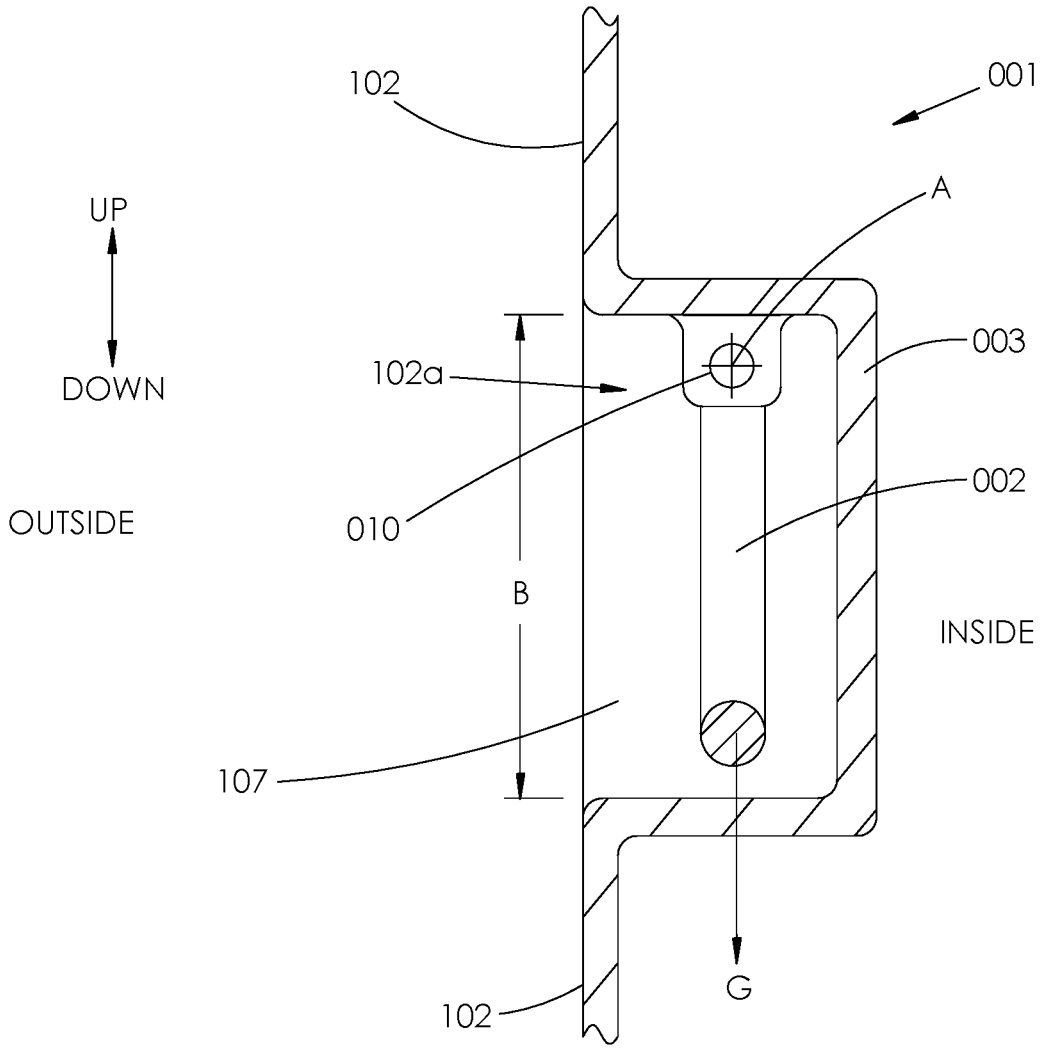
FIG. 8 depicts a side cross section view of an embodiment of the invention in which the shell is molded, formed or fabricated to be an integral part of a watercraft exterior surface. This embodiment is useful, for example and not by way of limitation, in situations in which the handle and shell of the invention, or just the shell of the invention, are fabricated by the OEM boat manufacturer at the time of manufacture of the watercraft surface, such that the shell is formed when the watercraft surface is formed, and forms a part of the watercraft surface. In this view, the handle is depicted as it would appear in use on a watercraft in normal (upright, or non-capsized) operation, with the handle rotatably attached to the housing, hanging in a downward position under the force of gravity. In the embodiment depicted, the handle does not protrude beyond the boat hull surface.

Referring now to FIG. 8, a side cross section view of an embodiment of the invention is depicted in which the shell 003 is molded, formed or fabricated to be an integral part of the watercraft exterior surface 102. This embodiment is useful, for example and not by way of limitation, in situations in which the handle 002 and shell 003 of the invention, or just the shell 003 of the invention, is fabricated with by the OEM boat manufacturer at the time of manufacture of the boat, such that the shell is formed when the boat hull is formed, and forms a part of the boat hull. In FIG. 8, the handle 003 is depicted as it would appear in use on a watercraft (e.g., a boat) in normal (upright, or non-capsized) operation, with the handle 003 rotatably attached at rotatable attachment 010, having an axis of rotation A, to the shell 003, handle 002 hanging in a downward position under the force of gravity such that handle grasping portion 200 is oriented in a downward position. In the embodiment depicted, in which the watercraft is disposed in an upright (i.e., non-capsized) position, the handle 003 does not protrude beyond the watercraft surface 102. The shell 003 may have an interior volume 107 for housing handle 002.

Figure 9:
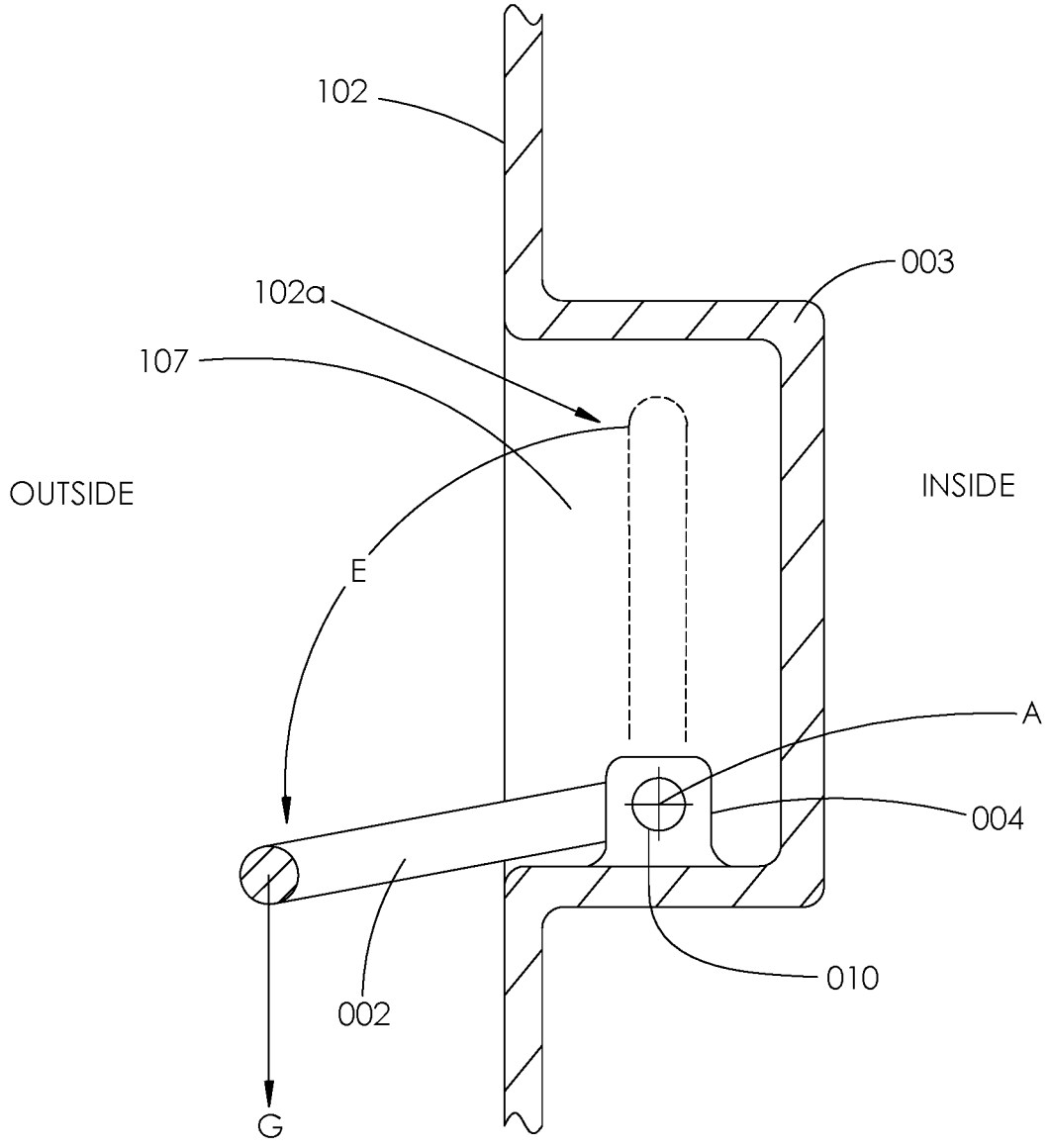
FIG. 9 depicts a side cross section view of an embodiment of the invention in which the shell is molded, formed or fabricated to be an integral part of a boat hull. This embodiment is useful, for example and not by way of limitation, in situations in which the handle and shell of the invention, or just the shell of the invention, is fabricated with by the OEM boat manufacturer at the time of manufacture of the boat, such that the shell is formed when the boat hull is formed, and forms a part of the boat hull. In this figure, the handle is depicted as it would appear in a "deployed" state or position in use on a watercraft in a capsized, or overturned (upside down), state, with the handle rotatably attached to the housing, the handle being automatically rotated outward from the cavity, in a direction away from the boat hull, under the force of gravity such that a person in the body of water would be able to grasp the handle, or releasably attach themselves to the handle, for example while awaiting rescue.

Referring now to FIG. 9, a side cross section view of an embodiment of the invention in which the shell 003 is molded, formed or fabricated to be an integral part of a watercraft exterior surface 102. This embodiment is useful, for example and not by way of limitation, in situations in which the handle and shell of the invention, or just the shell of the invention, is fabricated with by the OEM boat manufacturer at the time of manufacture of the boat, such that the shell is formed when the boat hull is formed, and forms a part of the boat hull. In this figure, the handle 002 is depicted as it would appear in use on a watercraft in a capsized, or overturned (upside down), state, with the handle 002 rotatably attached to the shell 003 in rotatable attachment 010 having an axis of rotation A, the handle 002 being automatically rotated form an initial position shown in broken lines, outward from the cavity, in a direction E away from the shell and watercraft exterior surface 102, under the force of gravity such that a person in the body of water would be able to grasp the handle 002, or releasably attach themselves to the handle 002, for example while awaiting rescue. The shell 003 may have an interior volume 107 for housing handle 002. After the handle has rotated out along direction E, it may be described as being "deployed".

Figure 10:
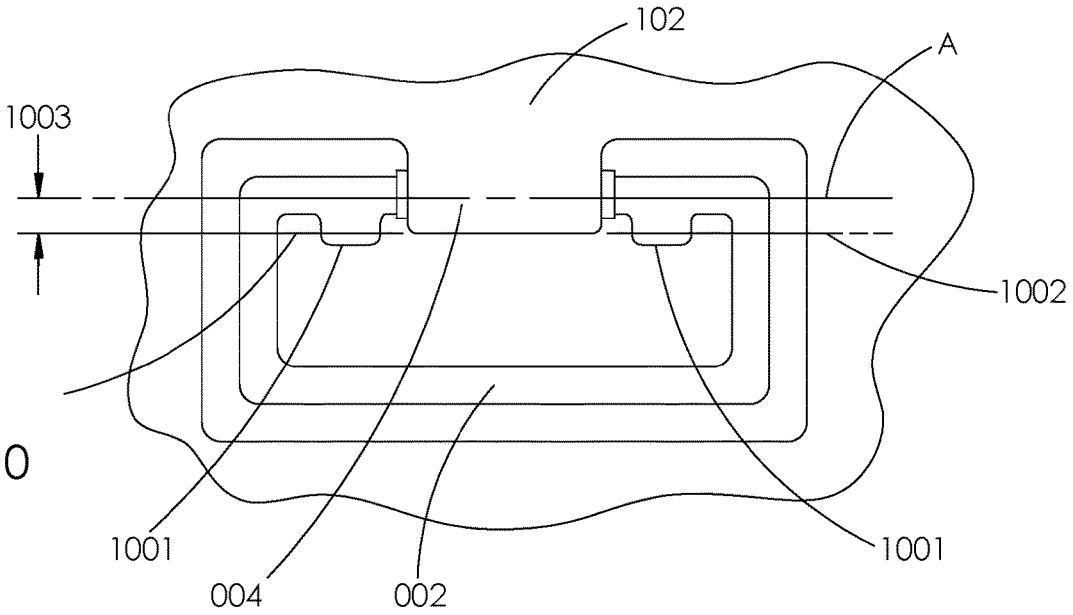
FIG. 10 depicts a front view of an embodiment of the inventive lifesaving handle system, as it would appear in use on a watercraft in normal operation (i.e., upright, or non-capsized), with the handle rotatably attached to the shell, hanging in a downward position under the force of gravity. In the embodiment shown, two counterweight gravity-assist features in the form of protrusions 1001 assist in the deployment, or outward rotation of the handle, when the watercraft is capsized (i.e. is upside down in the water).

Referring now to FIG. 10, a front view of an embodiment of the inventive handle system, as it would appear in use on a watercraft in normal operation (i.e., upright, or non-capsized), with the handle rotatably attached to the housing, hanging in a downward position under the force of gravity, is depicted. In the embodiment shown, two counterweight gravity-assist features in the form of protrusions 1001 assist in the deployment, or outward rotation of the handle, when the watercraft is capsized (i.e. is upside down in the water).

Figure 11:
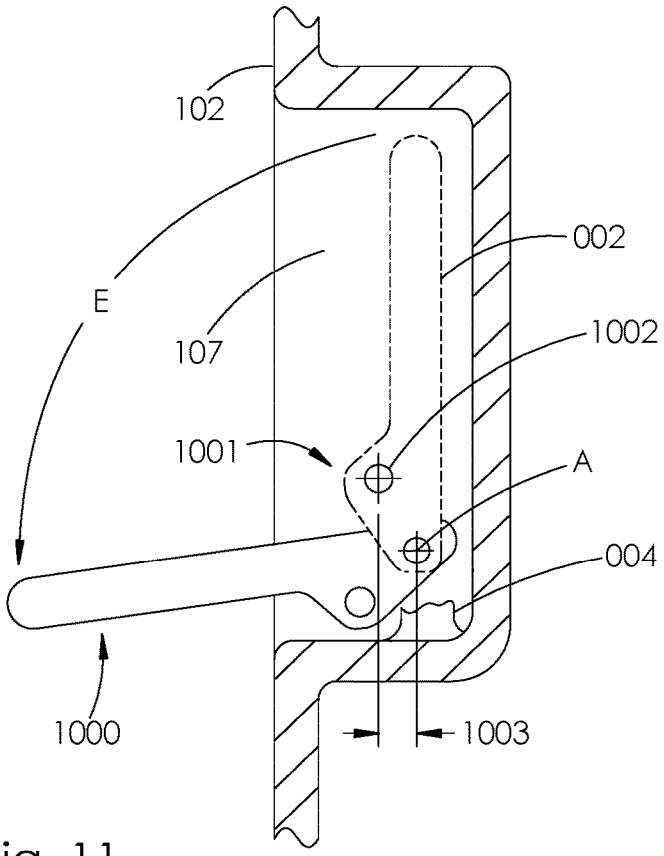
FIG. 11 depicts a side cross section view of an embodiment of the invention in which two gravity-assist features in the form of protrusions 1001 assist in the automatic deployment, or outward rotation of the handle, away from the shell, when the watercraft is capsized (i.e. is upside down in the water). The handle 002 is shown rotating from an initial non-deployed state when the boat has just been capsized, then rotating to a deployed state along arrow E with the assistance of at least one counterweight gravity-assist features in the form of protrusions 1001.

Referring now to FIG. 11, a side cross section view of an embodiment of the invention in which two gravity-assist features in the form of protrusions 1001 assist in the deployment, or outward rotation of the handle 002, when the watercraft is capsized (i.e. is upside down in the water). The handle 002 is shown in broken lines in an initial non-deployed state when the boat has just been capsized, rotating to a deployed state (depicted in broken lines) with the assistance of one or more counterweight gravity-assist features in the form of protrusions 1001. The counterweight gravity-assist features 1001 may take any shape, but no matter what the shape, they are characterized as having a center of mass 1002, which may, but does not necessarily, comprise an inserted weight fabricated from a dense material such as, for example, lead or steel, that is offset from the handle center of rotation A in a direction that tends to rotate the handle outward and away from shell 003 and watercraft surface 102 in the direction E when the watercraft is in an upside-down state, or position. Thus, in embodiments, the deployment of handle 002 by rotation in the direction of arrow E in the event of a watercraft capsize event that renders the watercraft upside down in the water may be automatic, i.e., requiring no human intervention, to deploy. The shell 003 may have an interior volume 107 for housing handle 002.

Figure 12:
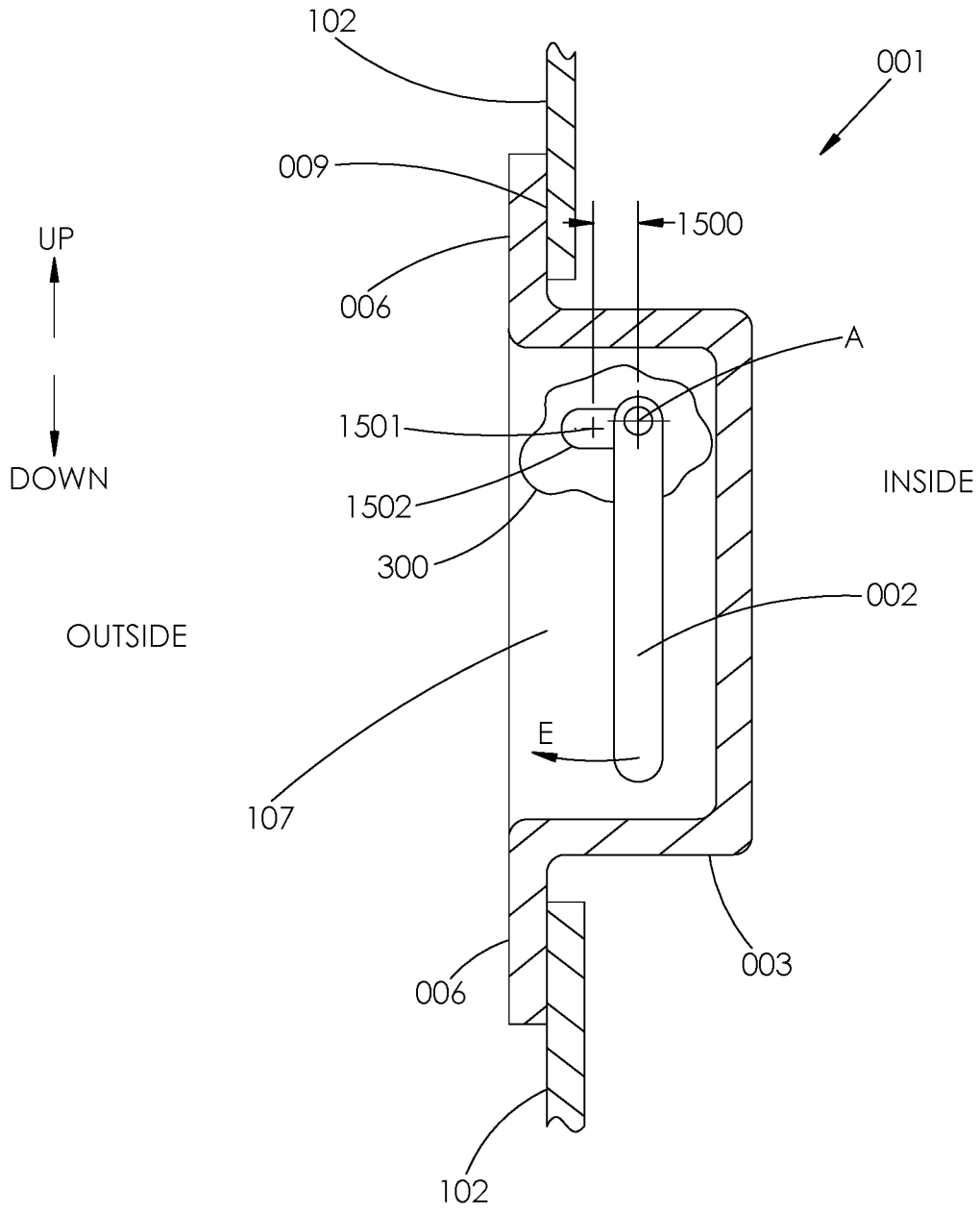
FIG. 12 depicts a cross section side view of an embodiment of the inventive lifesaving handle system having a counterweight, as it would appear in use on a watercraft in normal (upright, or non-capsized) operation, with the handle rotatably attached to the shell, hanging in a downward position under the force of gravity. In the embodiment depicted, the handle does not protrude beyond the boat hull surface when the watercraft is in a non-capsized state.
Figure 14:
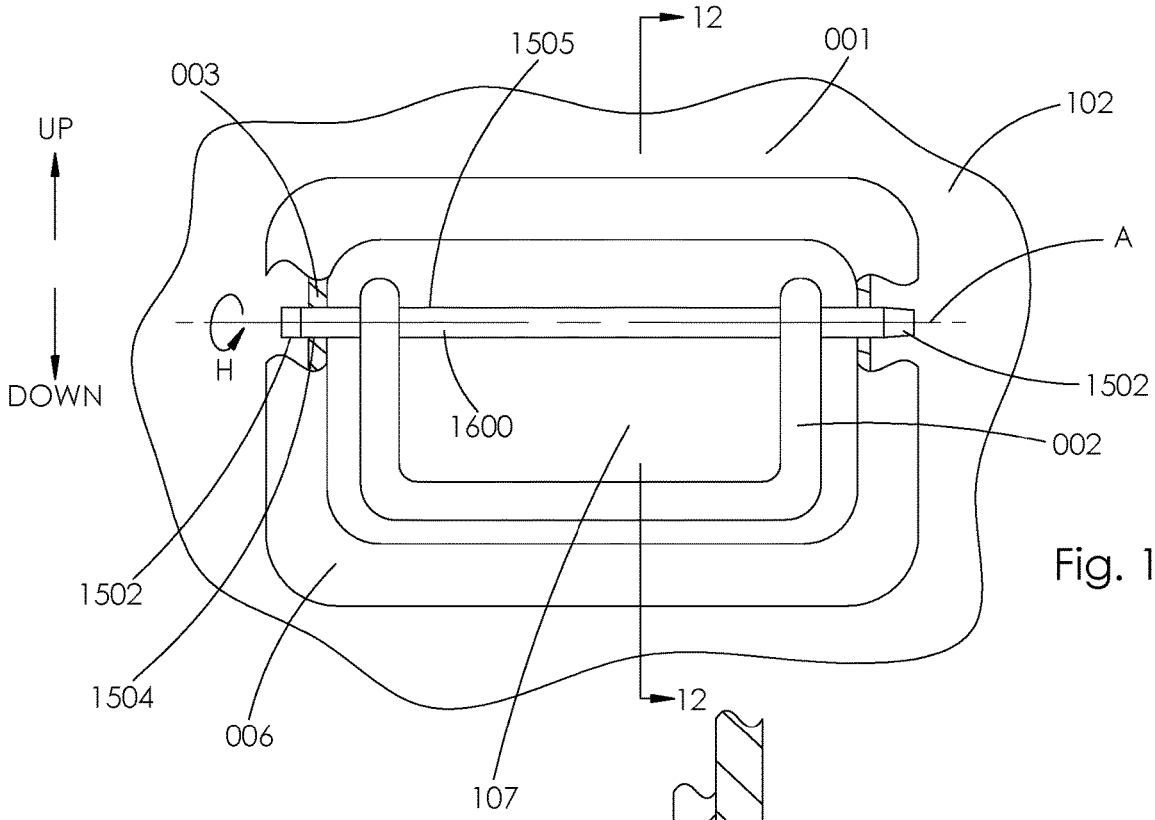
FIG. 14 depicts a front view of an embodiment of the inventive lifesaving handle system, as it would appear in use on a watercraft in normal operation (i.e., upright, or non-capsized), with the handle rotatably attached to the shell, hanging in a downward position under the force of gravity.
Figure 13:
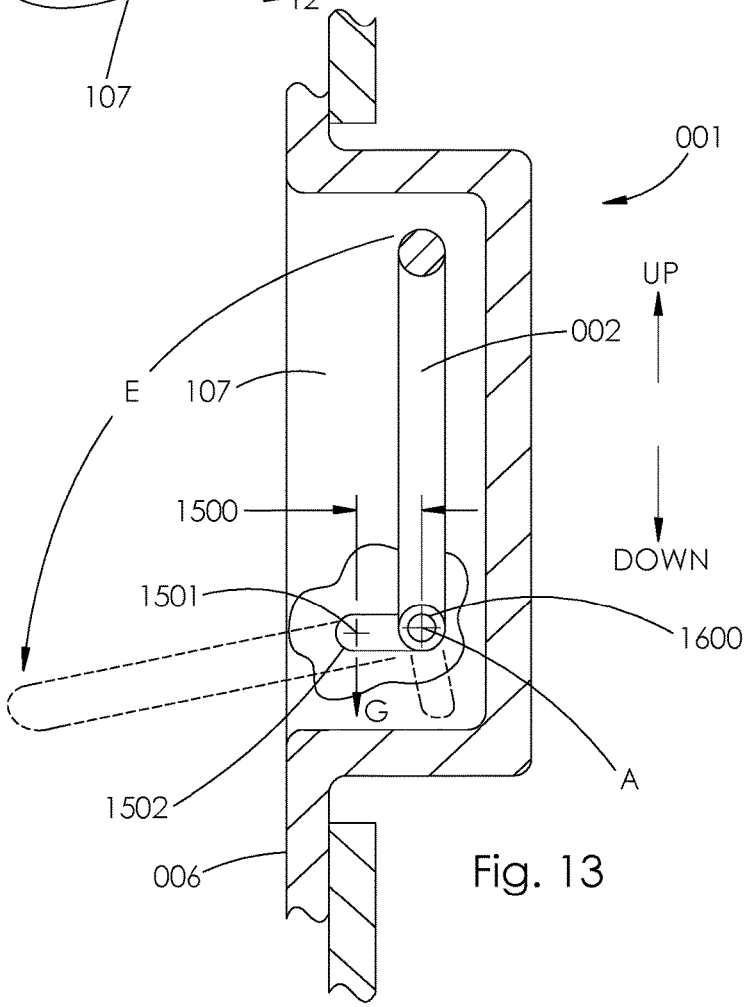
FIG. 13 depicts a side cross section view of an embodiment of the invention in which at least one gravity-assist features in the form of protrusions 1502 assist in the automatic deployment, or outward rotation, of the handle 002 along arrow E, when the watercraft is capsized (i.e. is upside down in the water). The handle 002 is shown in an initial non-deployed state when the boat has just been capsized, and rotating into a deployed state (shown in broken lines) with the assistance of the counterweight gravity-assist feature in the form of protrusion 1502.

Referring now to FIG. 12, a cross section side view of an embodiment of the inventive lifesaving handle system 001 having a counterweight gravity-assist feature, as it would appear in use on a watercraft in a normal (upright, or non-capsized) state, or position. Handle 002 may be rotatably attached to the shell 003, such that handle 002 hangs in a downward position from the axis of rotation A under the force of gravity when the watercraft is in an upright, i.e. non-capsized, state or position as shown in FIG. 12. In the embodiment depicted, the handle 002 does not protrude beyond the boat hull surface 102 so as to minimize drag when the watercraft is in a non-capsized state. The handle 002 may comprise one or more counterweight gravity-assist features in the form of protrusions 1502. The counterweight gravity-assist features 1502 may take any shape, but no matter what their shape, they are characterized as having a center of mass 1501, which may, but does not necessarily, comprise an inserted weight fabricated from a dense material such as, for example, lead or steel, that is offset from the handle center of rotation A in a direction that tends to rotate the handle outward and away from shell 003 and watercraft surface 102 when the watercraft is in said an upside-down state, or position, as depicted in FIG. 13. The "UP" and "DOWN" directions, relative to the force of gravity, are depicted for reference. In FIG. 12, the wall of shell 003 is depicted as broken away 300 so that counterweight feature 1502 which, in the embodiment shown is located on the far side of shell wall such that counterweight feature 1502 is located in an inside volume of the watercraft, is visible. The inventive lifesaving handle system 001 may, but does not necessarily, comprise two counterweights 1501 on either end of rotatable axle 1600 (see also FIG. 14 depicting rotatable axle 1505 rotatable about axis A as depicted by arrow H). The attachment 009 between watercraft surface 102 and flange 006 which may be, for example and not by way of limitation, chemical bonding, holds the shell 003 fixedly attached to watercraft surface 102 and is shown for reference. Shell interior volume 107 is shown for reference.

Referring now to FIG. 13, a side cross section view of an embodiment of the inventive lifesaving handle system 001 in which one or more gravity-assist features in the form of protrusions 1502 assist in the deployment, or outward rotation of the handle along arrow E, when the watercraft is a capsized state, or position, (i.e. is upside down in the water). The handle 002 is shown in an initial non-deployed state as when the boat has just been capsized, in which it is about to rotate along arrow E on axle 1600, around axis A, to a deployed state (shown in broken lines in FIG. 13) with the assistance of at least one counterweight gravity-assist feature in the form of protrusion 1502. The "UP" and "DOWN" directions, relative to the force of gravity, are depicted for reference. Shell interior volume 107 is shown for reference.

Referring now to FIG. 14, a front view of an embodiment of the inventive lifesaving handle system 001, as it would appear in use on a watercraft in normal operation (i.e., upright, or non-capsized state or position), with the handle rotatably attached to the housing, hanging in a downward position under the force of gravity. In the embodiment shown, a counterweight gravity-assist feature in the form of protrusion 1502 assists in the deployment, or outward rotation of the handle on axle 1600 which is rotatably attached to a sidewall of shell 003 on either end of axle 1600 via rotating attachment between axle 1600 outer surface 1505 with a receiving opening or other features in the sidewalls of shell 003 such that axle 1600 is able to rotate about axis A as depicted by arrow H. When the watercraft is capsized (i.e. is upside down in the water) such as depicted in FIG. 13, handle 002, which is attached on either end to axle 1600, is able to rotate in into a deployed state as shown in FIG. 13. Shell interior volume 107 is shown for reference.

Referring now to FIGS. 15 and 16, side views of a watercraft 100, in normal operation, floating upright (non-capsized) on a body of water (FIG. 15) and floating in an upside-down, or capsized, state on a body of water (FIG. 16) are depicted. In the example shown in these figures, the inventive lifesaving handles 001 are specifically located on the watercraft so as to be above the waterline 101 of the watercraft 100 when the watercraft is both in a capsized state and a non-capsized state. Referring specifically to FIG. 15, when the watercraft 100 is in an upright, non-capsized state, one or more handles 001 are located above waterline 101 by distance J (and down from the gunwale 1605 of the watercraft by distance K) such that they are not located in the water, and do not produce drag on watercraft 100, when the watercraft 100 is upright and in motion. However, referring now to FIG. 16, when the watercraft 100 is in an upside down, or capsized, state, the handles remain above the waterline by a distance L. This possible when a watercraft 100 "floats higher" in the upside down, or capsized, state than when in the right-side-up, or non-capsized state. In this embodiment, distance K is carefully selected to place at least one handle 001 above the waterline when the watercraft 100 is in both the right-side-up, or non-capsized state and also when the watercraft is in the upside down, or capsized, state.

In embodiments, the grasping portion 201 of handle 002 may be disposed within cavity 107 of shell 003 such that it does not extend out of shell 003, and does not extend beyond the exterior watercraft surface 102, when the handle is not deployed when the watercraft is in an upright, non-capsized state, condition or position; but the grasping portion 201 of handle 002 may extend out of shell 003, beyond the exterior watercraft surface 102, when the handle is deployed when the watercraft is in an upside down, or capsized, state, condition or position. This is depicted, for example, in FIGS. 6, 9, 11, and 13.

What is claimed is:

1. A handle system for a watercraft, comprising:

a shell forming a cavity in a substantially vertical exterior surface of the watercraft, said cavity having an interior volume;

a handle comprising an opening therethrough, said opening creating a grasping portion of the handle;

wherein the handle is rotatably attached in a rotatable attachment to an upper interior surface of the shell when the watercraft is disposed in an upright position;

wherein the handle hangs in the shell with the grasping portion of the handle oriented in a downward position when the watercraft is in said upright position; and wherein, when the watercraft is capsized into an upside-down position, the handle rotates away and outward from the shell on said rotatable attachment;

wherein the grasping portion is sized to be grasped by a hand of a person in a body of water both when the watercraft is upright and when the watercraft is capsized.

2. The handle system of claim 1, wherein the shell is molded into the substantially vertical exterior surface of the watercraft such that the shell and the watercraft exterior surface form one piece.

3. The handle system of claim 1, wherein said shell comprises a flange attached to the substantially vertical exterior surface of the watercraft, and wherein the shell extends into a watercraft interior volume through an opening in the substantially vertical exterior surface of the watercraft.

4. The handle system of claim 1, wherein the shell comprises an organic polymer.

5. The handle system of claim 1, wherein the shell comprises a reinforced plastic material composed of glass fibers embedded in a resin matrix.

6. The handle system of claim 1, wherein the handle grasping portion comprises a finger-grip contoured surface.

7. The handle system of claim 1, wherein said rotatable attachment has an axis of rotation, and where said handle further comprises at least one counterweight gravity-assist feature having a center of mass that is offset from said center of rotation in a direction that tends to rotate the handle outward and away from the shell when the watercraft is in said upside-down position.

8. The handle system of claim 7, where said at least one counterweight gravity-assist feature is further defined as a plurality of counterweight gravity-assist features.

9. The handle system of claim 1, herein wherein said handle does not extend outward from the cavity beyond said watercraft exterior surface when the watercraft is disposed in an upright position.

10. A watercraft, comprising:

a watercraft exterior surface;

wherein said watercraft exterior surface comprises a handle system, said handle system comprising:

a shell forming a cavity in a substantially vertical exterior surface of the watercraft, said cavity having an interior volume;

a handle comprising an opening therethrough, said opening creating a grasping portion of the handle;

wherein the handle is rotatably attached in a rotatable attachment to an upper interior surface of the shell when the watercraft is disposed in an upright position;

wherein the handle hangs in the shell with the grasping portion of the handle oriented in a downward position when the watercraft is in said upright position; and wherein, when the watercraft is capsized into an upside-down position, the handle rotates away and outward from the shell on said rotatable attachment;

wherein the grasping portion is sized to be grasped by a hand of a person in a body of water both when the watercraft is upright and when the watercraft is capsized.

11. The watercraft of claim 10, wherein the shell is molded into the substantially vertical exterior surface of the watercraft such that the shell and the watercraft exterior surface form one piece.

12. The watercraft of claim 10, wherein said shell comprises a flange attached to the substantially vertical exterior surface of the watercraft, and wherein the shell extends into a watercraft interior volume through an opening in the substantially vertical exterior surface of the watercraft.

13. The watercraft of claim 10, wherein the shell comprises an organic polymer.

14. The watercraft of claim 10, wherein the shell comprises a reinforced plastic material composed of glass fibers embedded in a resin matrix.

15. The watercraft of claim 10, wherein the handle grasping portion comprises a finger grip contoured surface.

16. The watercraft of claim 10, wherein said rotatable attachment has an axis of rotation, and where said grip further comprises at least one counterweight gravity- assist feature having a center of mass that is offset from said center of rotation in a direction that tends to rotate the handle outward and away from said shell when the watercraft is in said upside-down position.

17. The watercraft of claim 16, where said at least one counterweight gravity-assist feature is further defined as a plurality of counterweight gravity-assist features.

18. The watercraft of claim 10, wherein the handle system is disposed in the watercraft exterior surface at a location that is above a waterline of the watercraft exterior surface when the watercraft is in a non-capsized state.

19. The watercraft of claim 10, wherein the handle system is disposed in the watercraft exterior surface at a location that is above a waterline of the watercraft when the watercraft is in a capsized state.

20. The watercraft of claim 10, wherein said handle does not extend outward from the cavity beyond said watercraft exterior surface when the watercraft is disposed in an upright position.

21. The watercraft of claim 10, wherein the handle system is disposed in the substantially vertical exterior surface of the watercraft at a location that is above a waterline of the watercraft exterior surface when the watercraft is in a non-capsized state; and wherein the handle system is disposed in the watercraft exterior surface at a location that is above the waterline of the watercraft when the watercraft is in a capsized state.

* * * * *